United States Patent [19]

Hughes

[11] Patent Number: 4,630,750

[45] Date of Patent: Dec. 23, 1986

[54] CONTAINER CAM LOCK

[75] Inventor: Joel Hughes, Wilmington, N.C.

[73] Assignee: Container Products Corp., Wilmington, N.C.

[21] Appl. No.: 821,038

[22] Filed: Jan. 22, 1986

[51] Int. Cl.[4] ..... B65D 45/16

[52] U.S. Cl. ..... 220/324; 220/315

[58] Field of Search ..... 220/315, 214, 324; 292/113

[56] References Cited

U.S. PATENT DOCUMENTS 4,331,257 5/1982 Taschner ..... 220/324

4,371,092 2/1983 Teague ..... 220/324

*Primary Examiner*—George T. Hall

[57] ABSTRACT

A latch assembly for a removable lid container that includes a cam lock assembly. The container to be sealed provides a removable lid that has a depending peripheral-defining flange which has hingedly attached thereto a cam lock lever that includes a cam bar which is adapted to be rotatably positioned beneath a cam lock carried by the juxtapositioned side wall of the container when the lid is placed thereon and secured thereto. The cam lever provides a means which will receive a locking pin that cooperates with a receptive structure formed on the side wall of the container by which the cam lock may be secured in a latched position.

8 Claims, 3 Drawing Figures

CONTAINER CAM LOCK

BACKGROUND OF THE INVENTION AND PRIOR STRUCTURES

In the past there has been many forms of lid locks that were used on containers which were adapted to be filled with waste material, including radioactive wastes, that required the lid to not only be contained upon the container in a closed position, but in some manner be structured so that a visual inspection could determine whether or not the lid was properly secured and locked in place prior to disposal. One form of such a permanent lid hold down assembly is disclosed in U.S. Pat. No. 4,371,092, dated Feb. 1, 1983.

The present invention differs from the prior lid closure in that prior to its final closing the lock may be reopened for compression and repacking of waste material within the container so as to fully utilize the volume available for such function.

GENERAL DESCRIPTION OF THE INVENTION

The objects of this invention is to provide a latch assembly by which a lid may be positively secured upon and seal a waste container. The latch assembly includes a security seal that will give visual evidence that the lid is permanently latched upon the container.

Adapted to be pivotally attached to the peripherally depending flange of a lid is a hinged cam lock lever. This lever includes a cam lock bar that is adapted to be rotatably positioned beneath a cam latch that is carried by the side wall of the container. The cam lock lever also includes a means for the reception of a security pin that will cooperate with a retainer also carried by the side wall of the container by which the cam lock lever may be permanently secured in a locked position.

The advantages of this latch assembly includes a provision for a positive lid container closure assembly that includes a security seal and one that may be reopened for reentry into the container as required. A latch assembly of this construction is highly efficient for packing radioactive wastes and possesses such integrity that it has successfully met the standard tests, including but not limited to a water spray test; a free drop test; compression tests; penetration tests and reduced ambient pressure tests, all imposed by the Federal Code of Regulations relating to safe disposal of radioactive waste material.

GENERAL DESCRIPTION OF THE DRAWINGS

Figure 1:
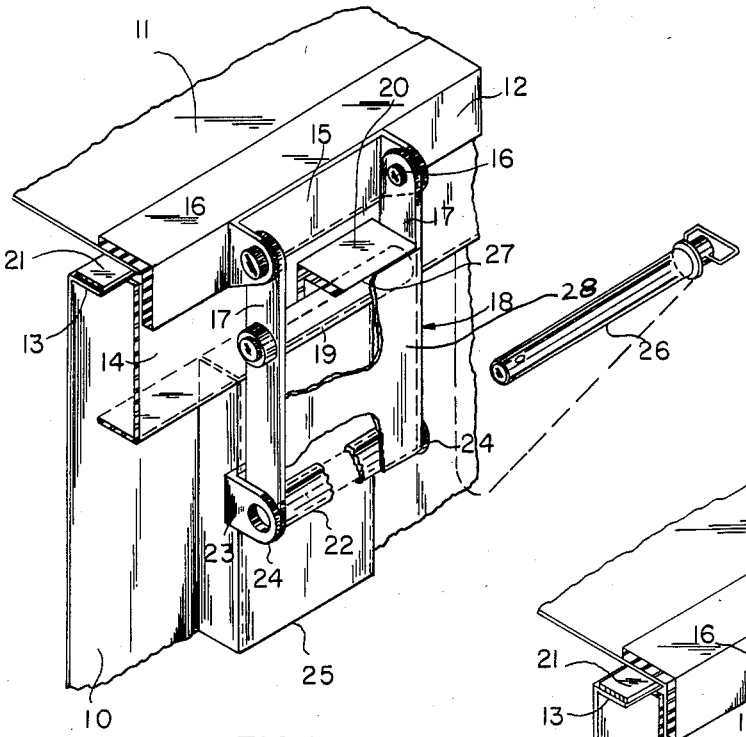
Figure 2:
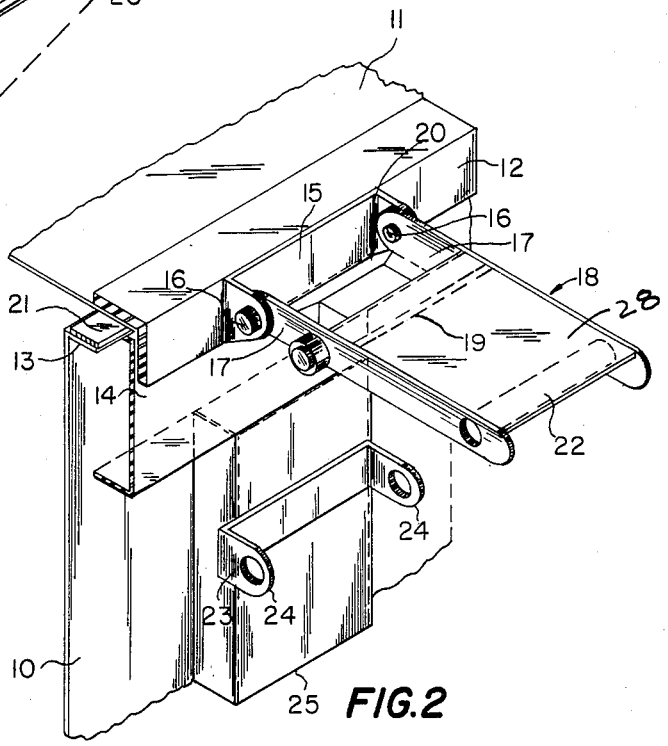
Figure 3:
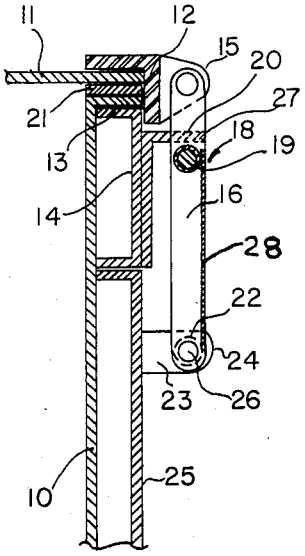

The Invention will be best understood by reference to the accompanying drawings which illustrate a preferred mode of construction by which the objects of this invention are achieved and in which;

FIG. 1 is a fragmentary detailed sectional view of the container cam lock in a locking position with the security pin detached with respect thereto, FIG. 2 is a detailed fragmentary sectional view similar to FIG. 1 but showing the cam lock lever in an open position and FIG. 3 is a fragmentary detailed sectional side elevational view of the container cam lock in a closed and secured position.

GENERAL DESCRIPTION

The container cam lock of this invention is adapted to be used with a normally opened top container that includes a front and back wall as well as two side walls.

As illustrated in the drawings only a portion of one side wall 10 is shown. It should be noted however, that while only one container cam lock is shown it is proposed that a series of the structures be arranged and carried by all of the walls of the container as required.

Also shown fragmentarily is a lid 11. This lid 11 provides a depending peripheral flange 12 that is adapted to overlie a horizontally peripheral flange 13 of the container. Carried beneath the horizontal peripheral flange 13 of the container is a U-shaped channel member 14 that functions to reinforce said periphery of the container. This channel member 14 is also overlaid by the depending flange 12 of the lid 11.

Adapted to be mounted on the exterior surface of the flange 12 is a U-shaped hinge bracket 15. Hingedly mounted to the bracket 15 by suitable hinge members 16 are the parallel arms 17 of the latch assembly 18.

Extending between the arms 17 of the latch assembly 18 and spaced from the hinge members 16 is a cam lock lever 19. This cam lock lever 19 is adapted to be functionally associated with a cam lock 20 which takes the form of an angle iron which is fixedly attached to the channel member 14 at a point beyond the bottom edge of the flange 12 of the lid 11.

The relation between the cam lock lever 19 and cam lock 20 as shown in FIG. 1 is such that when the latch assembly 18 is in its latched positon the cam lock lever 19 has been positioned beneath the cam lock 20 so as to secure the lid 11 onto the container. In such a latch positon the cam lock lever 19 must be forcefully cammed beneath the cam lock 20 in a manner such that a sealing gasket 21 carried on the exposed surface of the horizontal peripheral flange 13 of the container is compressed by the lid 11 so as to effectively seal the container to the ambient atmosphere.

Adjacent the free ends of the arms 17 of the latch assembly 18 and positioned therebetween is a tube 22 that has open communication with openings formed in each of the arms 17. The tube 22, when the latch assembly 18 is in its closed or sealing position, as illustrated in FIG. 1, will be in alignment with a security bracket 23. This security bracket 23 is generally U-shaped so as to provide spaced apart arms 24 which project outwardly from a reinforcing rib 25, carried by the side wall 10. By this arrangement the security bracket 23 is in vertical alignment with the hinge bracket 15 when the latch assembly 18 is in a operational position upon the container. A security lock pin 26 may then be projected through the security bracket 23, as well as the tube 21, so as to present a means by which the latch assembly 18 can be permanently sealed or secured in its locked position.

As the cam lock lever 19 is forcefully cammed beneath the cam lock 20 the latter may have its free outward edge cambered as at 27. This will assist the camming of the cam lock 20 into a latching position and permit the forceful compression of the lid 11 and its sealing gasket 21 into a sealed and locked position.

To prevent exposure of the cam lock lever 19 and cam lock 20 when in their locking position, a skin or shield 28 may extend between the arms 17. This shield 28 will prevent accidental movement of the latch assembly 18.

From the foregoing I have described a novel latch assembly for a removable lid that permits unlatching and removal of the lid from the container for repeated access to the interior thereof. The latch assembly provides a security pin latch by which the latch assembly may be permanently locked in its locking position with the security pin giving visual indication of such condition.

While I have described and illustrated the preferred method for carrying my invention into effect this is capable of variation and modification without departing from the spirit of the invention. I therefore, do not wish to be limited to the precise details as set forth, but desire to avail myself of such variations and modifications as come within the scope of the appended claims.

Having thus described my invention what I claim as new and desire to protect by Letters Patent is:

1. A locking assembly between a removable lid and a four sided, open top waste container, comprising, (a) a rotatable latch assembly carried by the lid to be locked upon the open top of the container, (b) means for hingedly mounting said latch assembly to the lid for movement from a plane parallel to the lid into a plane perpendicular to the lid and parallel to the side of the container, (c) said latch assembly including a latch lever rotatable therewith into and out of a latching position, (d) latch means provided by the container and in the path of movement of said latch lever as it is rotated with said latch assembly into contact therewith as said assembly is rotated perpendicular to the lid and parallel to the side of the container so as to secure the lid upon the container, and (e) means for releasably locking said latch lever in contact with said latch means contacted thereby for preventing rotatable movement of said latch lever out of a lid locking position.

2. A locking assembly as defined by claim 1 wherein said latch lever comprises an elongated circular element extending parallel to the hinged axis of said means hingedly mounting said latch assembly to the lid.

3. A locking assembly as defined by claim 1 wherein said latch means is a flange projecting outwardly from the side wall of the container and having a free end disposed in the path of movement of said latch lever.

4. A locking assembly as defined by claim 2 wherein said latch means is a flange projecting outwardly from the side wall of the container and having a free end disposed in the path of movement of said elongated circular element.

5. A locking assembly as defined by claim 1 wherein said means for releasably locking said latch lever in contact with said latch means comprises a security pin projectable through said latch assembly and into a fixed retainer carried by the side wall of the container.

6. A locking assembly as defined by claim 5 wherein said latch lever comprises an elongated circular element extending parallel to the hinged axis of said means hingedly mounting said latch assembly to the lid.

7. A locking assembly as defined by claim 5 wherein said latch means is a flange projecting outwardly from the side wall of the container and having a free end disposed in the path of movement of said latch lever.

8. A locking assembly as defined by claim 1 including a sealing gasket carried by the container and engageable by the lid when said locking assembly latches the lid upon the container.

* * * * *